United States Patent [19]

McGinley

[11] Patent Number: 4,907,627

[45] Date of Patent: Mar. 13, 1990

[54] WEFT GUIDE AND SHED RETAINER FOR A FLUID JET LOOM

[75] Inventor: Thomas F. McGinley, Clearwater, Fla.

[73] Assignee: Picanol NV, Polenlaan, Belgium

[21] Appl. No.: 263,268

[22] Filed: Oct. 27, 1988

[51] Int. Cl.[4] ..... D03D 47/00

[52] U.S. Cl. ..... 139/11; 139/435 E

[58] Field of Search ..... 139/11 R, 11 A, 435, 139/439, 188

[56] References Cited

U.S. PATENT DOCUMENTS

| | | | |
|---|---|---|---|
| 3,139,118 | 6/1964 | Svaty et al. | 139/127 |
| 3,203,452 | 8/1965 | Svaty | 139/127 |
| 3,525,369 | 8/1970 | Vystrlil | 139/127 |
| 3,742,973 | 7/1973 | Kakac | 139/127 P |
| 3,796,236 | 3/1974 | Kamp | 139/439 |
| 3,828,828 | 8/1974 | Cernocky et al. | 139/127 P |
| 3,847,187 | 11/1974 | Buran et al. | 139/127 P |
| 4,190,067 | 2/1980 | Kuda et al. | 139/435 |
| 4,425,946 | 1/1984 | McGinley | 139/11 |
| 4,438,790 | 3/1984 | Steiner | 139/435 |
| 4,492,254 | 1/1985 | Steiner | 139/11 |
| 4,492,255 | 1/1985 | Steiner | 139/11 |

*Primary Examiner*—Henry S. Jaudon

*Attorney, Agent, or Firm*—Bell, Seltzer, Park & Gibson

[57] ABSTRACT

A shed retaining and weft guide member for multiple shed, fluid jet looms includes a tubular section with mating male and female ends, a thickened end wall portion, a weft thread exit slot biased to a closed position during weft insertion, and a tapered bore section, all provided to increase the efficiency of fluid jet weft thread insertion by minimizing loss of fluid pressure and momentum.

5 Claims, 3 Drawing Sheets

WEFT GUIDE AND SHED RETAINER FOR A FLUID JET LOOM

FIELD OF THE INVENTION

The present invention relates to a weft guide and shed retainer for an air jet loom and in particular to a weft guide and shed retainer especially adapted for use in connection with multi-shed warp-wave looms having moving shed retaining elements.

BACKGROUND OF THE INVENTION

In a multi-shed warp-wave loom, multiple shed retainers are employed which sustain multiple sheds traveling in a wave-like form in a direction parallel with the warp threads toward the fell of the cloth. Each of these sheds receives a weft thread, which is usually inserted by a fluid jet (i.e., air). A separate shed forming apparatus is usually provided for forming the warp sheds by elevating and lowering alternate warp threads in a conventional manner.

Multi-shed weaving systems have been developed which utilize a fluid jet of fluid, usually air to insert the weft thread through the open sheds. In such devices the fluid, along with the weft thread, are directed through a weft guide channel and shed retainer positioned within the open warp shed. The weft guiding channel is necessary to direct the jet of air or liquid within the open shed, and to maintain the speed of the jet at the velocity required for transporting the weft thread completely through the open shed while preventing the jet from interfering with the warp threads forming the open shed. Reference is made to U.S. Pat. No. 4,425,946 for a complete and detailed description of such multi-shed weaving systems utilizing a fluid jet for weft insertion.

In a shed retainer for a multi-shed loom utilizing a fluid jet, such as an air jet, for weft insertion, a problem arises in terms of efficiency of weft insertion due to the nature of the construction requirements for the shed retainers. For example, as disclosed in U.S. Pat. No. 4,425,946, weft guide shed retainers can be formed as individual, slotted tubular sections that must be inserted between the warp threads into each shed, moved toward the fell of the fabric to hold the shed open, and then removed from the shed between the warp threads while disengaging the inserted weft thread. The multi-segmented construction of the weft guide shed retainers inherently requires discontinuites between the various segments which results in leakage of air and loss of fluid momentum traveling through the shed retainer. Inherently, the efficiency of weft insertion is affected by the mass and velocity of the fluid traveling through the shed retainer through which the weft is inserted.

SUMMARY OF THE INVENTION

The present invention relates to a weft guide element particularly suited for a multiple shed, fluid jet weft insertion loom of the type described in U.S. Pat. No. 4,425,946. In particular, the guide and shed retainer is configured so that it can be readily inserted between the warp threads after formation of a shed and thereafter serve to retain the shed while moving toward the fell of the cloth. The guide and retainer is tubular except for a slot extending through the side wall of the retainer so that the retainer is able to convey fluid and guide the weft thread during weft insertion, yet will enable the weft thread to be released from the retainer when the retainer is disengaged from the shed.

The guide and retainer is configured generally like diagonal slices of a tube such that it can be rotated from an open or shed disengaged position to a closed or shed engaging position, whereat it presents virtually a cylindrical tube to the warp and weft threads. By arranging a multiplicity of retainers across the shed area, when they are rotated together to a shed engaging position, a continuous generally cylindrical weft guide tube is presented to each weft to be inserted in the sheds, and the exterior of the guide tube engages the warp threads. Each guide and retainer is configured such that leakage of air between individual shed retainers is minimized and such that the weft conveying stream of fluid is focused by the inner wall configuration of the shed retainers to guide the weft essentially centrally through the adjacent retainers during weft insertion.

In addition, leakage of fluid between adjacent retainers is minimized by increasing the length of the leakage path between end faces of adjacent retainers through the use of interfitting male and female end surfaces between adjacent retainers and by providing a tapered bore opening within each retainer that tends to focus the moving insertion jet stream centrally inwardly towards the center line of the bore section of each retainer. The tapered bore section furthermore has the effect of reducing the pressure differential between adjacent retainers due to the acceleration effect on the moving jet stream at the bore constriction that tends to reduce the pressure in the immediate vicinity of the line of intersection between adjacent retainers when they are in the closed, weft guiding and shed retaining position.

In addition, the guide and retainers are formed such that the downstream ends of each retainer (relative to flow of insertion fluid) are radially thicker than the upstream ends of the next adjacent downstream retainer to provide increased fluid blockage effect across the open upstream end of the weft exit slot of the next adjacent downstream (in the weft inserting direction) retainer, particularly in the vicinity of the slot interior where it is enlarged to facilitate weft exit movement without tangling the inserted weft thread.

BRIEF DESCRIPTION OF THE DRAWINGS

Further objects, features and advantages of the present invention will become apparent upon the consideration of the following detailed description of a preferred embodiment of the invention when taken in conjunction with the accompanying drawings wherein.

DETAILED DISCUSSION OF PREFERRED EMBODIMENT OF THE INVENTION

While the present invention is capable of being incorporated in curved or flat multi-shed weaving systems, it is especially suited for use in connection with a flat multiphase or multished weaving loom which utilizes multiple sheds traveling in a wave-like manner in a direction parallel to the warp threads using a fluid jet weft thread insertion means. Reference is made to U.S. Pat. No. 4,425,946 for a complete and detailed description of such a multi-shed weaving loom, including a prior art weft guide and shed retainer.

Figure 1:
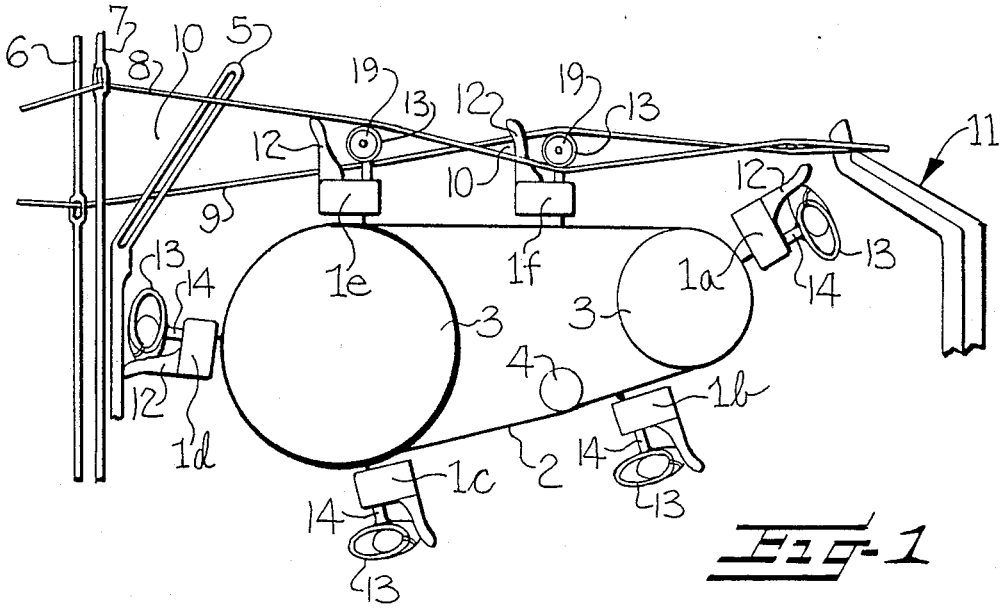
FIG. 1 is a schematic side elevational view of a multi-shed weaving loom incorporating the improved weft guide and shed retainers of the present invention.
Figure 2:
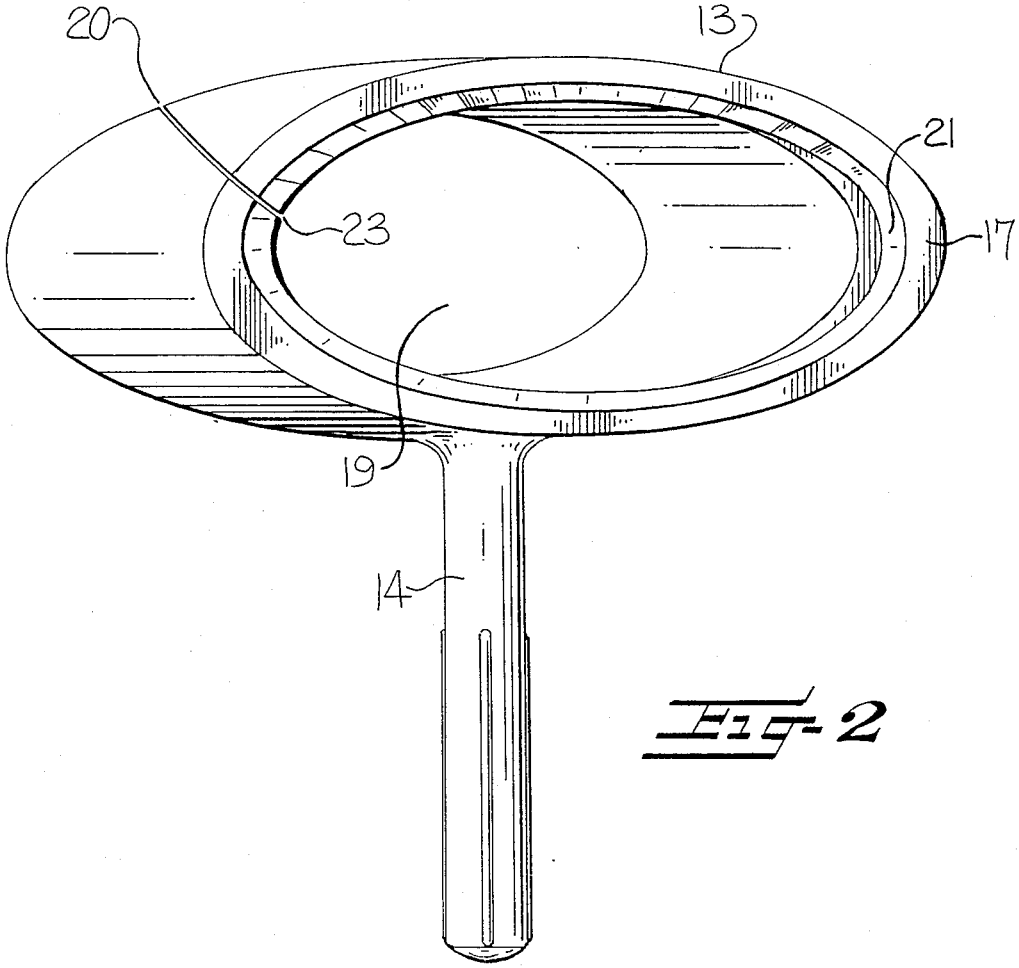
FIG. 2 is a side elevational view of the improved weft guide and retainer of the present invention in the open position.
Figure 3:
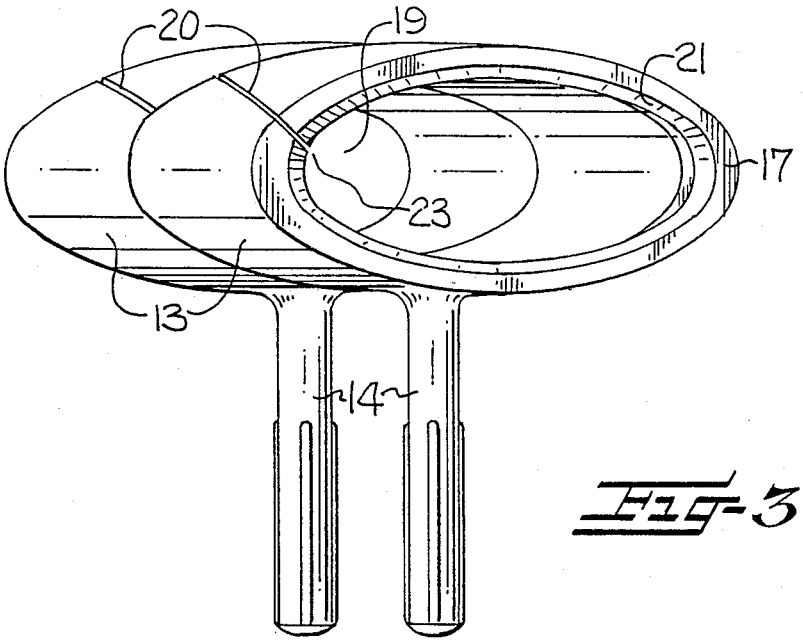
FIG. 3 is a rear elevational view of a pair of adjacent guide and retainer elements in closed position.

Referring now to FIG. 1 of the drawings, there is schematically illustrated a portion of a multi-shed weaving loom of the type intended for utilization of the weft guide and shed retainers of the present invention. U.S. Pat. No. 4,425,946 may be referred to for a fuller description of the details of such a loom, including the weft guide transporting and rotating system. As shown in FIG. 1, the weaving loom comprises several weft guide and shed retaining stations 1*a*, 1*b*, 1*c*, 1*d*, 1*e* and 1*f*. The weft guide and shed retainer elements disposed at the stations may variously be referred to as weft guides or shed retainers in the ensuing description. Each of the shed retaining stations is mounted for movement on a conveyor system including a conveyor 2 driven by sprockets 3 (in a clockwise direction as shown), and an additional sprocket 4 provided for tensioning the conveyor. Heddles 6,7 are provided for forming an initial shed 10 between the warp threads 8, 9. A beat up mechanism 11 is provided for beating up the weft thread into the fell of the fabric following release of the warp threads by the shed retaining elements, and removal of the retainers from the warp. Optional weft advance arms 12 may be provided on the shed retaining stations.

As shown as station 1*d*, the shed retainers 13 preferably are elongated oviod in shape and are partially turned, prior to and during their insertion into an open shed, so that the longer axis of the retainers extend substantially parallel to the warp threads 9 while the retainers are being inserted and removed from the shed. The retainers can best be envisioned as diagonal slices of a tube.

A support stem 14 is attached to the lower portion of the retainers 13 connecting them with each station 1*a*–1*f*. Each stem 14 supports the tubular section of the shed retainer 13 for rotation between two positions. In a first position, shown at station 1*d*, the tubular section of the shed retainer is turned so that its narrow dimension or axis lies substantially parallel to the warp threads 9 and warp receiving openings are provided between the shed retainer elements. This facilitates insertion and exit of the shed retainers 13 into and out of the formed sheds of warp threads.

Figure 4:
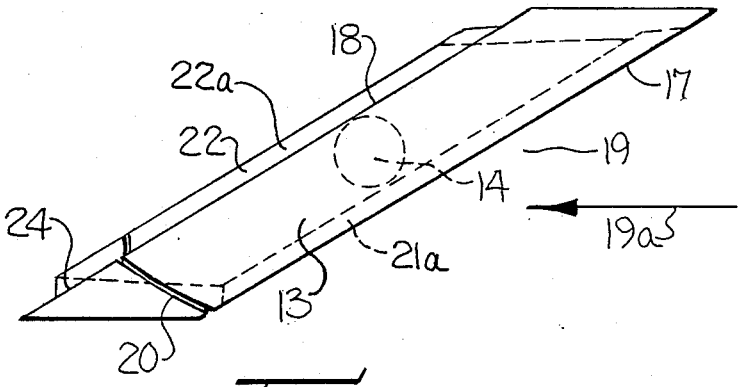
FIG. 4 is a plan view of the guide and retainer shown in FIG. 2.
Figure 5:
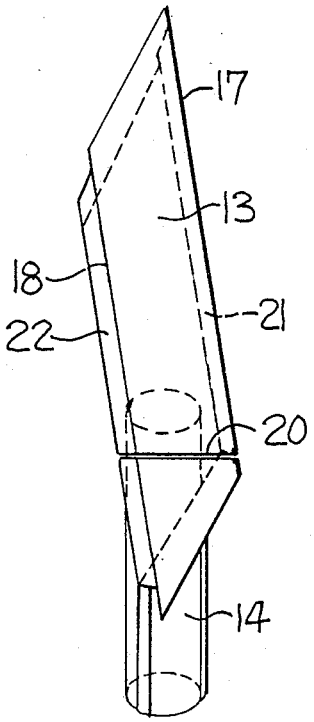
FIG. 5 shows the guide and retainer in plan view rotated towards its position for exit from the warp threads.

Following insertion of the shed retainers 13 into the shed the retainers are turned to their second position shown at station 1e, where they are in their shed guiding and retaining position. In this position, the longer dimension or axis extends generally in the weft direction, and a virtual circular tube is presented for weft insertion. As each of the retainers 13 are moved by the conveyor 2 from the position of station 1d to the position of station 1e, and as heddles 6,7 form the next shed, the upper surface 15 of the tubular section of the retainers 13 engages the upper warp threads, and the lower surface 16 engages the lower warp threads, thereby retaining each shed 10 and moving it toward the fell. As will be described in more detail below, in the second or warp thread engaging position, the downstream end 18 (relative to the stream of insertion fluid) of each shed retainer 13 is adapted to abut the upstream end 17 of the next adjacent downstream shed retainer (see FIGS. 4 and 5). Moreover, as shown at 1*e* and 1*f*, with their respective ends in mutual contact, the bores 19 of the shed retainers 13 cooperate to form a continuous, substantially closed weft guide bore through which the weft thread can be inserted by a fluid jet in the direction of arrow 19*a*. The force of the insertion fluid jet transports the weft thread completely through the continuous bore and thereby inserts the weft thread in the shed 10 retained by the shed retainers 13. The shed retainers 13 are maintained in their warp thread engaging positions as they travel across the top of the conveying system until a desired point is reached near the fell of the cloth, i.e., when the weft is fully inserted. At this point, the shed retainers 13 are actuated via stems 14 by means within the respective stations, for example in accordance with U.S. Pat. No. 4,425,946, to rotate back to their first or warp thread disengaging position, shown at station 1*a* in FIG. 1, to disengage the warp threads from the upper and lower surfaces 15, 16 respectively,and to release the inserted weft thread.

As each of the shed retainers 13 is turned from its warp thread engaging position to its warp thread disengaging position, the downstream end 18 of each tubular section of each of the shed retaining members 13 is spaced from the upstream end 17 of the next adjacent downstream tubular section of retaining member 13. When each of the shed retainers 13 are in their warp thread disengaging position the weft thread exit slots 20 are substantially aligned with the weft thread permitting release of the weft thread into the closing shed, with the shed retainers located in a position which facilitates withdrawal of the shed retainers from between the warp threads as shown at station 1a. The beat up of the weft thread, which has been inserted into the warp shed, occurs following release of the weft thread from the shed retainer bores 19, for example by a beat up mechanism of the type disclosed in U.S. Pat. No. 4,425,946.

Figure 6:
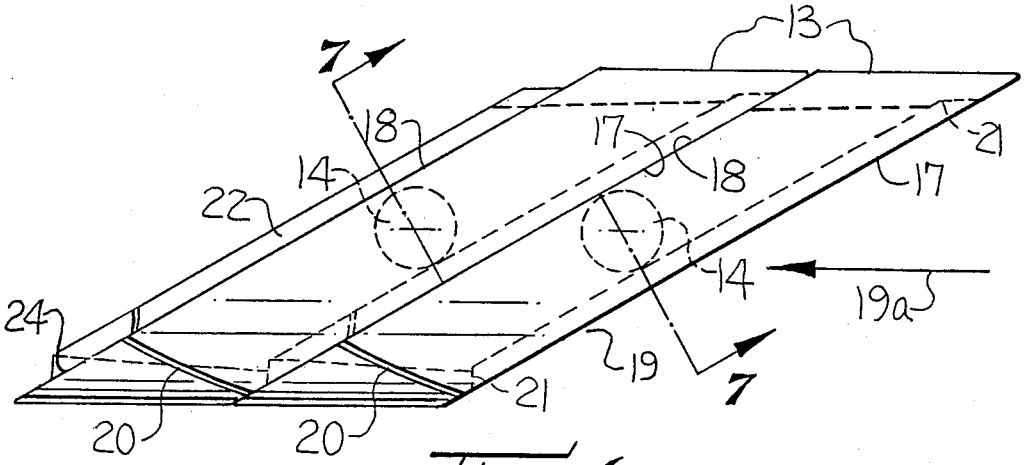
FIG. 6 is a plan view of adjacent guide and retainer elements in closed position.
Figure 7:
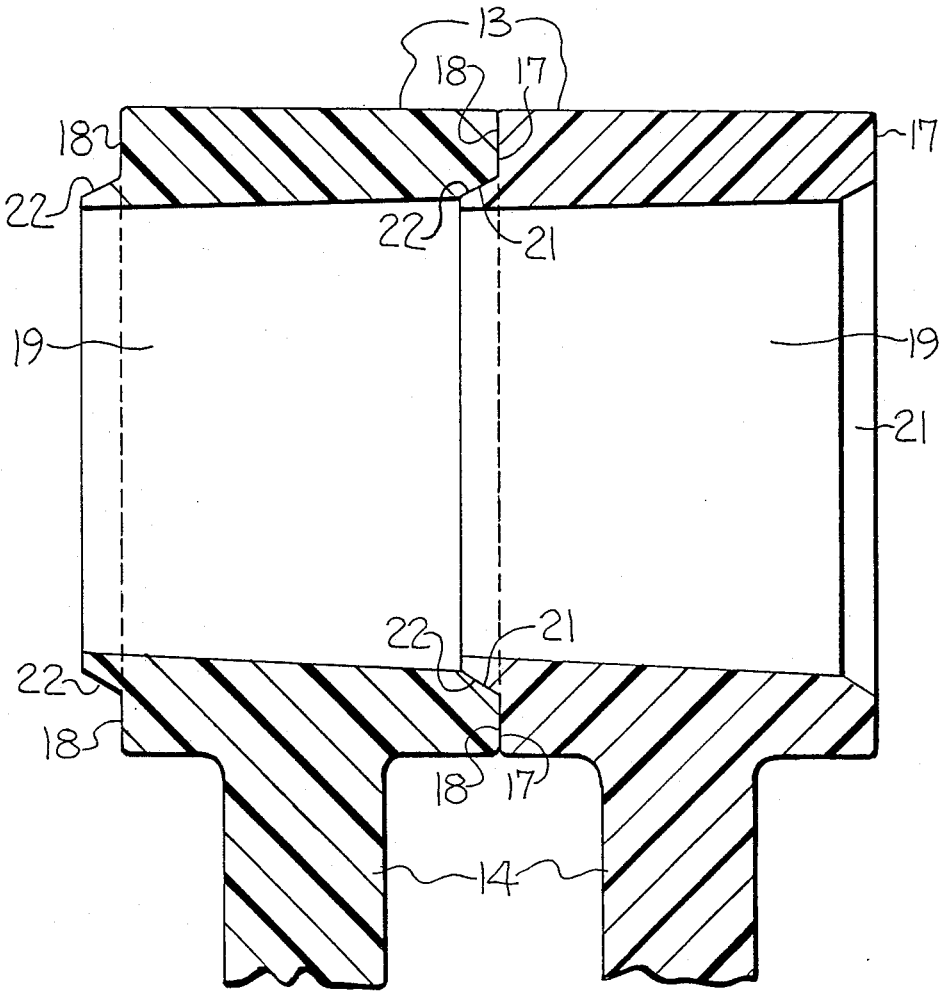
FIG. 7 is an elevational section view of a pair of guide and retaining elements taken along line VI—VI of FIG. 6.

Referring now to FIGS. 2 to 7, a shed retainer according to the present invention is illustrated in greater detail. Each shed retainer includes a stem or support member 14 which carries a normally open slotted tubular section 13. The tubular section of retainer 13 has generally parallel ends 17, 18 extending perpendicular to the narrow dimension or length of the retainer 13 and a bore 19 extending lengthwise through the retainer between the two ends 17, 18. End 17 is the "upstream" end relative to the weft insertion stream of fluid, and end 18 is the "downstream" end of the shed retainer and weft guide 13. At the end 17 of the retainer, proximate to where the bore 19 emerges from the end 17, a female recess 21 defined by generally axially (relative to the bore 19) extending wall surface 21*a* is provided. This recess 21 extends around the periphery of the bore 19 thereby forming a female fitting at the end 17 of the shed retainer 13. At the opposite or downstream end 18 of the retainer, proximate to where the bore 19 emerges from the side 18, a male protrusion 22 defined by generally axially extending wall surface 22*a* is formed. The protrusion 22 extends around the periphery of the bore 19 thereby forming a male fitting at the end 18 of the retainer 13. The thus formed female and male fittings of the shed retainer are dimensioned to allow the male protrusion 22 to cooperate and mate together with the female fitting recess 21 of an adjacent shed retainer when the retainers are assembled adjacent each other across the shed of a loom and are turned to their shed retaining position as shown in FIGS. 6 and 7. This interlocking of the ends 17,18 of shed retainers 13 when they are turned to their shed retaining position increases the resistance to leakage of air or liquid from between adjacent shed retainers 13 during weft insertion by fluid jet insertion means by presenting a tortuous leakage path between the continuous bore and ambient.

It will be noted that the male and female configurations at the downstream and upstream ends of the retainers could be reversed if desired, the essential feature being the extended leakage path or sealing area provided by the male and female interlocking or cooperating surfaces.

The bore 19 of each shed retainer 13 preferably is tapered in the direction of weft insertion or towards the downstream side of each retainer. The cross-sectional area of the bore at the end 17 of the retainer 13 where the weft thread will first enter the bore 19 (i.e., the upstream end of bore 19) is larger than the cross-sectional area of the bore 19 at the end 18 of the retainer 13 (downstream end) where the weft thread will exit the bore 19 (see FIGS. 6 and 7). The interior taper of the bore 19 has a focusing or constricting effect on the air or liquid used in weft insertion, tending to keep the weft toward the center of the bore. This constriction also reduces fluid pressure (due to fluid acceleration) at the area of contact between adjacent shed retainers 13 and thereby reduces the amount of air or fluid lost at these areas. Also by directing the weft toward the center of bore 19, binding or catching of the weft thread in the weft exit slots 20 of the shed retainers 13 is minimized.

The weft exit slots 20 are normally open and extend from one end 17 of the retainer to the other end 18, and from the interior of the bore 19 to the exterior of the retainer 13. The slots 20 allow the weft thread to exit the bore 19 of the retainers when the retainers are turned to their shed disengaged position prior to their removal from between the warp threads. The interior approach to slot 20 in the bore 19 is tapered or has a V-like entrance at 23 to faciliate the weft thread exiting the retainer bore 19 when the retainers 13 are turned to their warp thread disengaging position and as they travel away from the warp threads between stations 1f and/or 1a in FIG. 1.

Preferably, the wall thickness of the tubular section of each retainer is greater at the downstream end of the tubular section of each retainer at the area opposite the upstream end of the exit slot 20 of the next downstream retainer. The increased thickness of the shed retainer will portion provides the respective end (i.e. 18 in the illustrated embodiment) with a larger wall surface area 24 at the downstream side of the retainer when the ends 17, 18 of the retainers are interlocked as in FIG. 6 which allows each retainer to overlap, to a greater degree, the end of each slot 20 approached by each exiting weft thread and tends to offset the leakage that might occur due to the pressure of taper 23 at this region when the retainers are moved to their warp thread engaging position (see FIG. 6). In this position, the larger surface 24 at the downstream end 18 of each shed retainer 13 engages and overlaps the upstream end of slot 20 where taper 23 is provided of the next downstream retainer. By presenting a thicker wall portion at the tapered open area or V- like entrance 23 of the weft thread exit slot, escape of air or fluid from this slot end is reduced due to the longer leakage path between the abutting surfaces. In particular, the loss of air or fluid through the exit slot taper 23 is reduced by the increased overlap of the upstream thickened end wall 24.

In operation, the shed retainers 13 are each rotated so that their thinner dimension is presented to the warp threads 9 as conveyor 2 advances each retainer station 1*a*–1*f* towards the formed sheds 10 on the loom as illustrated in FIG. 1. The retainers are generally oriented like the FIG. 5 position on entry between the warp threads, but are rotated somewhat due to their position on conveyor 2. Continued motion of the shed retainer station inserts each shed retainer 13 between the warp threads 9 into the shed area 10, whereupon each retainer 13 is rotated to its closed, shed retaining position as shown in FIG. 6, whereat the adjacent ends 17, 18 of the retainers are in virtual abutment. In this position, as previously explained, the enlarged end 24 serves to block the upstream, open end of weft exit slot 20 and the male and female end fittings defined by the protrusion 22 and recess 21 overlap to further increase the leakage path of fluid between adjacent tubular sections of retainers 13. Weft insertion through the tubular bores of the retainers by means of jets of fluid such as air then can occur while the sheds are held in their open position, as shown in FIG. 1. Leakage of air is minimized due to the increase leakage path between adjacent tubular sections of the shed retainers 13 and the tapered bore sections tend to focus the jets inwardly to better guide the weft threads through the bores of the retainers. Leakage is further minimized by decreasing the pressure differential between inside the bores and outside the retainers at the intersection between retainers. As the retainers approach the cloth fell, they are again rotated to the release position of FIG. 5 as they are conveyed out of the warp threads. The weft thread passes through the slot 20 just before its beat up.

It is to be understood that various modifications to the preferred embodiment could be made by a person skilled in the art without departing from the spirit and scope of the invention, which is recited in the appended claims below. In particular, the retainer embodying the invention could be arranged for use as a guide comb for an air jet loom wherein the retainer would move into and out of a single fixed shed area in a conventional manner. Also, various other male and female interlocking configurations could be used as the sealing surfaces for the ends of the weft guide and shed retaining elements, provided that a tortuous leakage path is provided between the continuous weft guide bore and ambient.

I claim:

1. In a weft guide and shed retainer for a multiple shed, fluid jet weaving machine, including multiple weft guide and shed retainer elements arranged to engage and to maintain a plurality of sheds between warp threads and to move so as to advance said shed toward the cloth fell during weaving, each of said weft guide and shed retainer elements including a normally open slotted tubular section arranged to receive, guide and release a weft thread inserted into the tubular section and transported therethrough by weft insertion fluid during weaving, each of said weft guide and shed retainer elements being arranged to be movable between a weft thread receiving and guiding position and a weft thread releasing position, and to cooperate with adjacent weft guide and shed retainer elements extending in a weftwise direction when in its weft receiving and guiding position for forming a substantially continuous weft guide bore through each shed area, the improvement comprising:

each of said weft guide and shed retainer elements including upstream and downstream ends relative to the insertion jet stream, said ends including sealing surfaces including axially and radially extending portions arranged to cooperate and mate with adjacent mating sealing surfaces on adjacent weft guide and shed retainer elements so as to present a tortuous leakage path for weft insertion fluid from the interior of the tubular section to ambient when the weft guide and shed retainer elements are in their weft receiving and guiding position.

2. In a fluid jet weaving machine, a weft guide system including a plurality of weftwise extending adjacent weft guide elements each defined by a slotted tubular section having upstream and downstream ends and being movable into and out of sheds of warp threads formed by a weaving machine during weaving, said guide elements presenting narrow lengths to the warp threads with warp receiving openings between the guide elements during entry and exit from each shed and being rotatable in a shed to positions whereat the ends about each other and the bores of the tubular sections are linked so that a continuous weft guide bore is presented by the tubular sections for receiving weft threads inserted by means of fluid jet streams during weaving, a slotted tubular section of each guide element defining a weft exit slot extending between the ends of each guide element arranged to enable separation of inserted weft threads from each weft guide element when the guide element exits a shed, the improvement comprising:

said ends including cooperating and mating abutting sealing surfaces including surfaces extending generally, axially and radially of the bores of the tubular sections, said axially and radially extending surfaces arranged to present a tortuous leakage path for weft insertion fluid between the interior of the weft guide bore and ambient.

3. In a weft guide and shed retainer for a multiple shed, fluid jet weaving machine, including multiple weft guide and shed retainer elements arranged to engage and to maintain a plurality of sheds between warp threads and to move so as to advance said sheds toward the cloth fell during weaving, each of said weft guide and shed retainer elements including a normally open slotted tubular section arranged to receive, guide and release a weft thread inserted into the tubular section and transported therethrough by weft insertion fluid during weaving, said weft guide and shed retainer elements being arranged to be movable between a weft thread receiving and guiding position and a weft thread releasing position, and to cooperate with adjacent weft guide and shed retainer elements extending in a weftwise direction when in its weft receiving and guiding position for forming a substantially continuous weft guide bore through each shed area, the improvement comprising:

each of said weft guide and shed retainer elements including upstream and downstream ends relative to the insertion jet stream, said ends including sealing surfaces including axially and radially extending portions arranged to cooperate and mate with adjacent mating sealing surfaces on adjacent weft guide and shed retainer elements so as to present a tortuous leakage path for weft insertion fluid from the interior of the tubular section to ambient when the weft guide and shed retainer elements are in their weft receiving and guiding position;

said tubular section including opposed upstream and downstream ends, and defining a termination at its downstream end at an area having a smaller cross section than its upstream end;

said slotted tubular section defined by annular side walls terminating at upstream and downstream end walls intersected by the ends of the slot and the tubular section, wherein the downstream end wall has a greater transverse width than the upstream end wall of the next adjacent downstream weft guide and shed retainer element, at least at the area of intersection of the last said shed upstream end wall and the slot of said downstream weft guide and shed retainer element.

4. In a weft guide and shed retainer for a multiple shed, fluid jet weaving machine, including multiple weft guide and shed retainer elements arranged to engage and to maintain a plurality of sheds between warp threads and to move so as to advance said shed toward the cloth fell during weaving, each of said weft guide and shed retainer elements including a normally open slotted tubular section arranged to receive, guide and release a weft thread inserted into the tubular section and transported therethrough by weft insertion fluid during weaving, said weft guide and shed retainer elements being arranged to be movable between a weft thread receiving and guiding position and a weft thread releasing position, and to cooperate with adjacent weft guide and shed retainer elements extending in a weftwise direction when in its weft receiving and guiding position for forming a substantially continuous weft guide bore through each shed area, the improvement comprising:

each of said weft guide and shed retainer elements including upstream and downstream ends relative to the insertion jet stream, said ends including sealing surfaces including axially and radially extending portions arranged to cooperate and mate with adjacent mating sealing surfaces on adjacent weft guide and shed retainer elements so as to present a tortuous leakage path for weft insertion fluid from the interior of the tubular section to ambient when the weft guide and shed retainer elements are in their weft receiving and guiding position;

said tubular section including opposed upstream and downstream ends, and defining a termination at its downstream end at an area having a smaller cross section than its upstream end;

said slotted tubular section defined by annular side walls terminating at upstream and downstream end walls intersected by the ends of the slot and the tubular section, wherein the downstream end wall has a greater transverse width than the upstream end wall of the next adjacent downstream weft guide and shed retainer element, at least at the area of intersection of the last said shed upstream end wall and the slot of said downstream weft guide and said retainer element;

said slotted tubular section defined by a discontinuous sidewall and wherein the slot extends along said discontinuity, said side wall including a tapered portion adjacent to the interior approach to the slot for facilitating release of a weft thread from within the tubular section.

5. In a fluid jet weaving machine, a weft guide system including a plurality of weftwise extending adjacent weft guide elements each defined by a slotted tubular section having upstream and downstream ends and being movable into and out of sheds of warp threads formed by a weaving machine during weaving, said guide elements presenting narrow lengths to the warp threads with warp receiving openings between the guide elements during entry and exit from each shed and being rotatable in a shed to positions whereat the ends abut each other and the bores of the tubular sections are linked so that a continuous weft guide bore is presented by the tubular sections for receiving weft threads inserted by means of fluid jet streams during weaving, a slotted tubular section of each guide element defining a weft exit slot extending between the ends of each guide element arranged to enable separation of inserted weft threads from each weft guide element when the guide element exits a shed, the improvement comprising:

said ends including cooperating and mating abutting sealing surfaces including surfaces extending generally, axially and radially of the bores of the tubular sections, said axially and radially extending surfaces arranged to present a tortuous leakage path for weft insertion fluid between the interior of the weft guide bore and ambient;

the bores of the tubular section being tapered with the smaller cross sectional area of each bore disposed at the downstream end of each guide element;

said slotted tubular section of each weft guide including a tapered sidewall area on the interior approach side of the slot to facilitate weft exit from the bore of the tubular section;

said slotted tubular sections defined by annular sidewalls terminating at upstream and downstream ends, the downstream end having a greater transverse width than the upstream end of the next adjacent downstream weft guide at least at the area of intersection of the upstream end of the downstream end guide and the slot of the tubular section of the downstream weft guide, whereby a sealing of the upstream end area of the downstream slot is effective.

* * * * *